US006764387B1

(12) United States Patent
Chen

(10) Patent No.: US 6,764,387 B1
(45) Date of Patent: Jul. 20, 2004

(54) CONTROL OF A MULTI-CHAMBER CARRIER HEAD

(75) Inventor: Hung Chih Chen, Santa Clara, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/384,249

(22) Filed: Mar. 7, 2003

(51) Int. Cl.[7] ..... A24B 1/00

(52) U.S. Cl. ..... 451/41; 451/286; 451/287; 451/288; 451/289; 451/398

(58) Field of Search ..... 451/41, 286–289, 451/398

(56) References Cited

U.S. PATENT DOCUMENTS 5,964,653 A 10/1999 Perlov et al.
6,390,905 B1 * 5/2002 Korovin et al. ..... 451/286
6,612,903 B2 * 9/2003 Korovin et al. ..... 451/9
6,648,740 B2 * 11/2003 Perlov et al. ..... 451/288
6,659,850 B2 * 12/2003 Korovin et al. ..... 451/286

* cited by examiner

*Primary Examiner*—Joseph J. Hail, III
*Assistant Examiner*—Alvin J. Grant
(74) *Attorney, Agent, or Firm*—Fish & Richardson

(57) ABSTRACT

An apparatus and method for chemical mechanical polishing in which a substrate is pressed against a polishing pad by a carrier head having a plurality of chambers. A common pressure is applied by the plurality of chambers in the carrier head using a common regulator, but a duration of application of the first pressure to each chamber from the plurality of chambers is controlled independently from other chambers.

18 Claims, 4 Drawing Sheets

CONTROL OF A MULTI-CHAMBER CARRIER HEAD

BACKGROUND

The present invention relates generally to chemical mechanical polishing of substrates, and more particularly to control of a carrier head for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer during photolithography. Therefore, there is a need to periodically planarize the substrate surface to provide a substantially planar layer surface.

Chemical mechanical polishing (CMP) is one accepted method of planarization. This planarization method typically requires that the substrate be mounted to a carrier or polishing head. The exposed surface of the substrate is then placed against a moving polishing pad. The carrier provides a controllable load on the substrate to press it against the polishing pad. A retaining ring can be used to center the substrate onto the carrier to prevent it from slipping laterally. By applying the downward force, while rotating the slurry-covered pad for a selected amount of time, a desired amount of material can be removed from the upper surface of the substrate to planarize it.

In order to obtain spatially uniform polishing across the surface of a wafer, it may be desirable to vary the pressure applied to the substrate at different locations. For example, it may be desirable to vary the pressure applied to different portions of the substrate to compensate for uneven polishing pad wear, non-uniform slurry distribution, or other sources of spatial non-uniformity in the polishing rate.

Accordingly, there is a need for a chemical-mechanical polishing method and apparatus that enables the user to vary the pressure applied to different regions of the wafer in a controlled manner, when it is desirable to enhance polishing uniformity.

SUMMARY

In one aspect, the invention is directed to a polishing system that has a carrier head with a plurality of pressurizable chambers, a common pressure regulation line having a first pressure, a plurality of second lines having a second pressure that is different than the first pressure, and a plurality of first valves. Each first valve is associated with one of the pressure chambers and is actuatable between a first position in which the first valve fluidly couples its associated pressure chamber with the common pressure regulation line and a second position in which the first valve fluidly couples its associated pressure chamber with one of the plurality of second lines.

Implementations of the invention may include one or more of the following features. The polishing system may include a pressure regulator and a second valve. The second valve may be actuatable between a first position in which the second valve fluidly couples the common pressure regulation line to the pressure regulator and a second position in which the common pressure regulation line is not fluidly coupled to the pressure regulator. In the second position the second valve may fluidly couple the common pressure regulation line to a vacuum source. The plurality of second lines may each vent to atmospheric pressure or may be coupled to a second common pressure regulation line. The polishing system may include a first pressure regulator, a second pressure regulator, a second valve, and a third valve. The second valve may be actuatable between a first position in which the second valve fluidly couples the common pressure regulation line to the first pressure regulator and a second position in which the common pressure regulation line is not fluidly coupled to the first pressure regulator, and the third valve may be actuatable between a first position in which the third valve fluidly couples the second common pressure regulation line to the second pressure regulator and a second position in which the second common pressure regulation line is not fluidly coupled to the second pressure regulator. In the second position the second valve may fluidly couple the common pressure regulation line to a vacuum source. In the second position the third valve may fluidly couple the second common pressure regulation line to a vent.

In another aspect, the invention is directed to a method for chemical mechanical polishing of a substrate. In the method, a substrate is pressed against a polishing pad with a carrier head having a plurality of chambers, relative movement is caused between the polishing pad and the substrate, and a common first pressure is applied to a plurality of chambers in the carrier head using a common regulator. A duration of application of the first pressure to each chamber from the plurality of chambers is controlled independently from other chambers.

Implementations of the invention may include one or more of the following features. A second pressure may be applied to a second chamber that controls a pressure on the substrate, and the second pressure may be controllable independently of the first pressure. A third pressure may be applied to a third chamber, and the third pressure may be controllable independently of the first and second pressures. The second pressure may be applied against an edge portion of the backside of the substrate, whereas the third pressure may be applied to a retaining ring surrounding the perimeter of the substrate to press the retaining ring against the polishing pad to retain the substrate. The substrate may be substantially circular, and the first pressure may be applied by the plurality of chambers to a portion of the substrate surrounded by the edge portion. The portion of the substrate surrounded by the edge portion may include a plurality of concentric zones, and each chamber from the plurality of chambers may apply the first pressure to one of the concentric zones from the plurality of concentric zones.

In another aspect, the invention is directed to a method for controlling the polishing pressure over the regions of a substrate in a chemical mechanical apparatus. In the method, a first pressure exerted on an edge region of the substrate is controlled by a first pressure regulator, and a second pressure exerted on a plurality of the substrate regions, other than the edge region, is controlled by a second pressure regulator. The amount of material removed from each region of the plurality of regions is controlled independently from other regions.

In another aspect, the invention is directed to a polishing system with a carrier head and a pressure controller. The carrier head includes a flexible membrane providing a substrate-mounting surface and a retaining ring joined to the base assembly. The volume between the base assembly and the flexible membrane forms a first chamber and a plurality of second chambers. The pressure controller applies a first pressure to the retaining ring, a second pressure to the first chamber and a first portion of the substrate, and a third pressure to the plurality of second chambers. Each of the plurality of second chambers applies the third pressure to an associated segment of the substrate.

Implementations of the invention may include one or more of the following features. A controller may independently control a duration of application of the third pressure to each chamber from the plurality of second chambers.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

One problem that has been encountered in applying different pressures to different regions of a substrate is that the conventional control schemes typically require multiple independent pressure regulators and valves. However, each of the pressure regulators has a limited accuracy and cannot identically match the pressures from the other pressure regulators. As a result, areas under control of different regulators in which the user desires to apply the same pressure might actually receive different pressures, adversely affecting the polishing uniformity of the substrate. In addition, a large number of pressure regulators and valves might be needed. The large number of components increases cost and reduces reliability.

Figure 1:
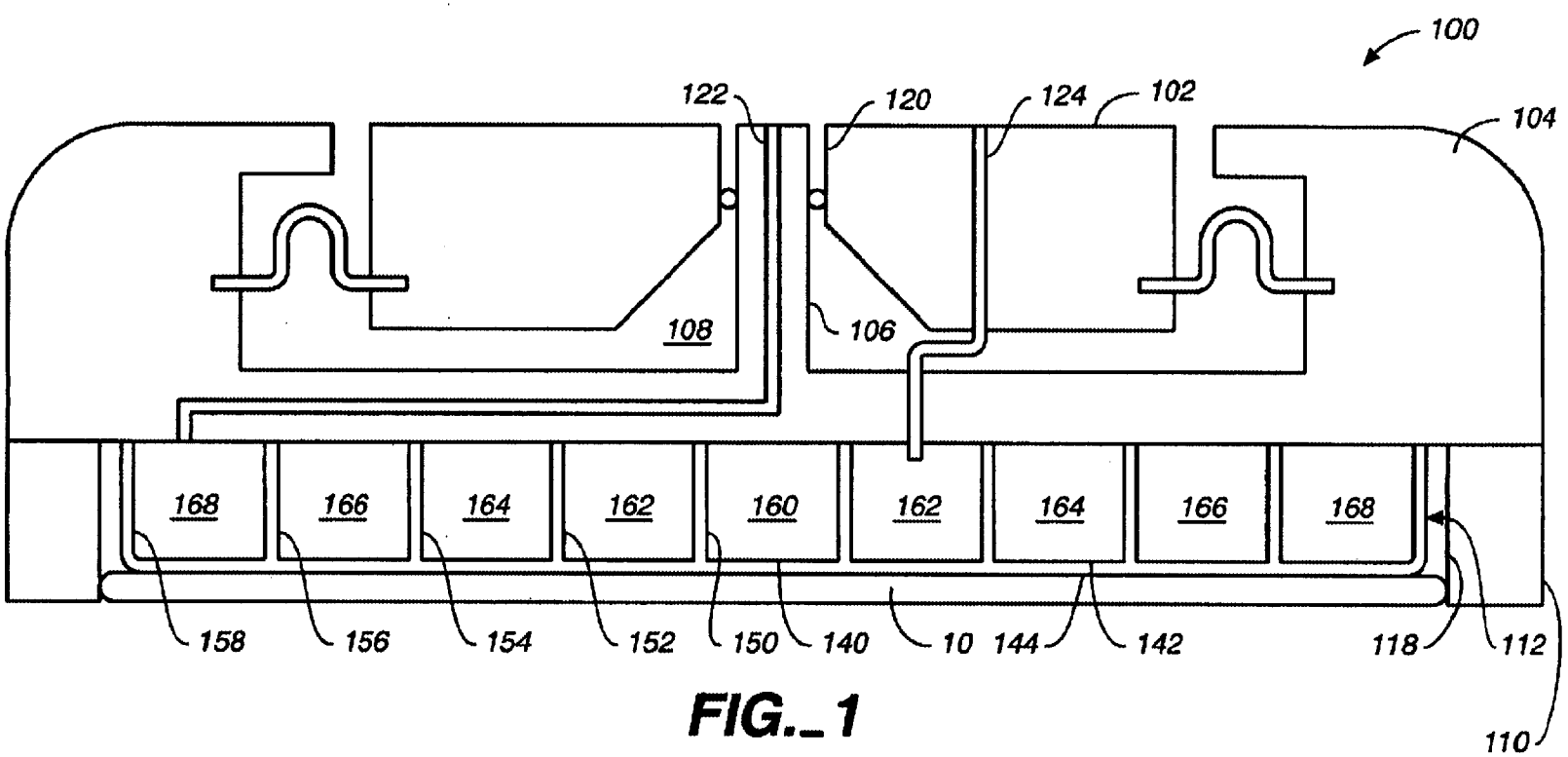
FIG. 1 is a schematic cross-sectional view of a carrier head for a chemical mechanical polishing system.

Referring to FIG. 1, the carrier head 100 includes a housing 102, a base assembly 104, a gimbal mechanism 106 (which may be considered part of the base assembly), a loading chamber 108, a retaining ring 110, and a substrate backing assembly 112 which includes multiple, e.g., five, pressurizable chambers. A description of a similar carrier head may be found in U.S. patent application Ser. No. 09/712,389, filed Nov. 13, 2000, the entire disclosure of which is incorporated herein by reference.

The housing 102 generally can be circular in shape and can be connected to the drive shaft to rotate therewith during polishing. A vertical bore 120 with a passage 122 may be formed through the housing 102, and five additional passages 124 (although only one passage is illustrated) may extend through the housing 102 for pneumatic control of the carrier head. The base assembly 104 is a vertically movable assembly located beneath the housing 102.

The loading chamber 108 is located between the housing 102 and the base assembly 104 to apply a load, i.e., a downward pressure or weight, to the base assembly 104. The vertical position of the base assembly 104 relative to the polishing pad 32 is also controlled by the loading chamber 108.

The retaining ring 110 may be a generally annular ring secured at the outer edge of the base assembly 104. When fluid is pumped into the loading chamber 108 and the base assembly 104 is pushed downwardly, the retaining ring 110 is also pushed downwardly to apply a load to the polishing pad. An inner surface 118 of the retaining ring 110 engages the substrate to prevent it from escaping from beneath the carrier head.

The substrate backing assembly 112 includes a flexible membrane 140 with a generally flat main portion 142. A lower surface 144 of the main portion 142 provides a mounting surface for the substrate 10. Five concentric annular flaps 150, 152, 154, 156 and 158 extend from the main portion 142 and are clamped to the base assembly 104 to form five pressurizable chambers 160, 162, 164, 166 and 168.

Each chamber can be fluidly coupled by passages through the base assembly 104 and housing 102 to an associated pressure source, such as a pump or pressure regulator. The fluid used to control the pressure in the chambers can be a liquid or a gas, such as air. One or more passages from the base assembly 104 can be linked to passages in the housing by flexible tubing that extends inside the loading chamber 108 or outside the carrier head. Thus, each chamber can be pressurized independently, and pressurization of each chamber, and the force applied by the associated segments of the flexible membrane 140 on the substrate, can be independently controlled. This permits different pressures to be applied to different radial regions of the substrate during polishing, thereby compensating for non-uniform polishing rates caused by other factors or for non-uniform thickness of the incoming substrate.

Figure 2:
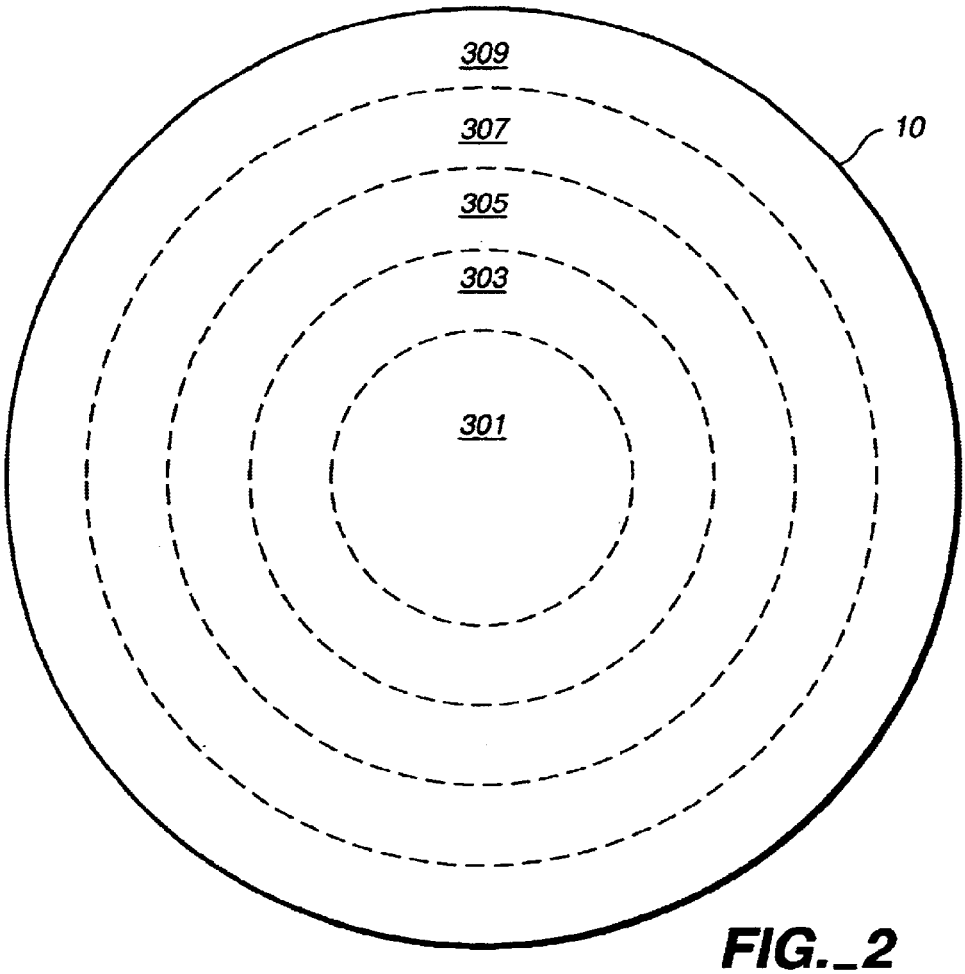
FIG. 2 is a schematic view of a substrate.

Referring to FIG. 2, for example, a typical substrate is substantially circular in shape. The substrate can include a central portion 301 and consecutive substantially annular concentric region zones 303, 305, 307 and 309 surrounding the central portion 301. In a typical polishing procedure, the substrate is substantially flat in the central portion 301, but can be potentially overpolished or underpolished in the concentric zones 303–309. For example, concentric zones 307 and 309 near the perimeter of the substrate can be overpolished, whereas zones 303 and 305 can be underpolished.

A conventional pressure control system that permits independent control of the pressures applied to the each of the zones 301–309 requires at least five pressure regulators (one for each zone) and five control valves. Additionally, another independent pressure regulator would be needed for control of the pressure applied to the retaining ring by the chamber 108.

The control system of the invention utilizes a common pressure regulator to simultaneously control the pressure of multiple chambers. However, the control system still permits independent control of the duration of the pressure to each of the chambers.

Figure 3:
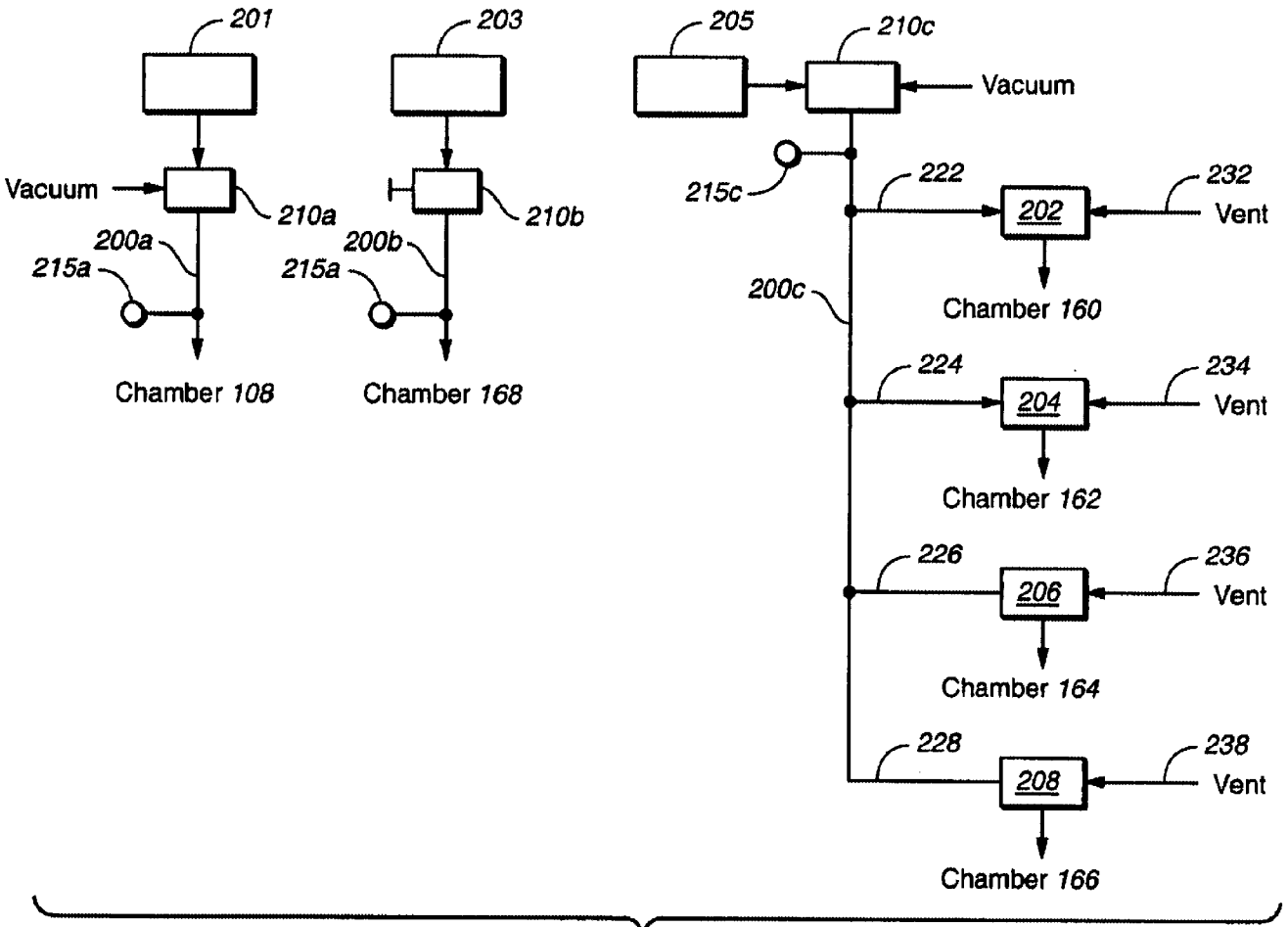
FIG. 3 is a block diagram of a polishing head control system according to one implementation of the invention.
Figure 4:
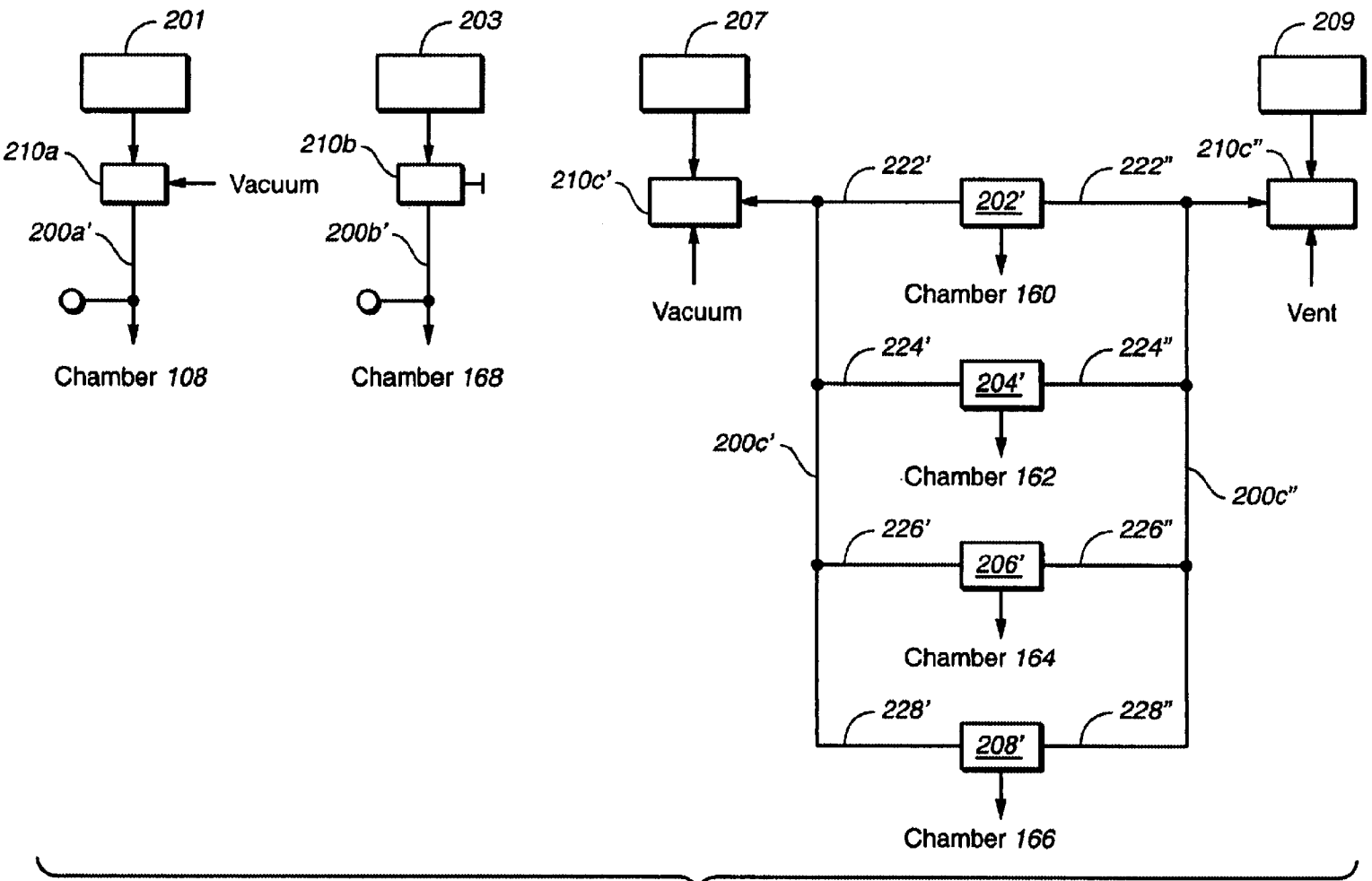
FIG. 4 is a block diagram of a polishing head control system according to another implementation of the invention.

FIGS. 3 and 4 illustrate two implementations of the invention designed to provide independent controllable pressures on the retaining ring 110, the edge portion 309 of the substrate 10, and the concentric zones 301–307. A potential advantage of these implementations is that they use fewer pressure regulators and control valves.

Referring to FIG. 3, three separate vacuum or pressure sources 201, 203 and 205, such as pumps, venturis, or pressure regulators, can be used to apply pressures to different groups of chambers. Specifically, the chamber 108 (and thus the retaining ring 110) is controlled by a first pressure source, for example pressure regulator 201, the chamber 168 (and thus the edge portion 309) is controlled by a second pressure source, for example, pressure regulator 203, and the remaining chambers 160–166 (and thus the concentric zones 301–307) are controlled by a single third pressure source, such as pressure regulator 205. Thus, chamber 168 can apply a first positive pressure to the edge portion 309 of the substrate, the plurality of chambers 160–166 can apply a second positive or negative common pressure to the concentric zones 301–307, respectively, and the retaining ring chamber 108 can apply a third positive or negative pressure against the retaining ring 110. Although one particular grouping of chambers is described, different groupings of chambers are possible for different applications.

Pressure regulators 201, 203 and 205 can be fluidly connected to the pressurizable chambers 108, 168, and 160–166, respectively, via associated fluid lines 200*a*, 200*b* and 200*c*. Three-way primary control valves 210*a*, 210*b* and 210*c* can be provided on the fluid lines 200*a*–200*c* to independently control whether each fluid lines 200*a*–200*c* is connected to its associate pressure regulator 201, 203 and 205, respectively, or to a vacuum source (in the case of fluid lines 200*a* and 200*c*) or a block (in the case of fluid line 200*b*).

A plurality of branch lines 222, 224, 226 and 228 can fluidly connect pressurizable chambers 160, 162, 164 and 166, respectively, to the fluid line 200*c*. Each of the branch lines 222, 224, 226, and 228 is provided with an associated secondary three-way control valve 202, 204, 206 and 208, respectively. Each of the secondary control valves 202–208 can independently control whether its associated chamber 160–166 is connected to the line 200*c* or to a secondary line 232, 234, 236 or 238. The secondary lines 232–238 can each vent to atmospheric pressure (and thus share a common pressure). Alternatively, each secondary line can be connected to a common line (which can vent to atmospheric pressure or be connected to another pressure regulator) so that the secondary lines share a common pressure.

When the primary control valve 210*c* connects the fluid line 200*c* to the pressure regulator 205, the secondary control valves 202–208 permit individual control of whether the chambers 160–166 are pressurized or vented to atmosphere. Similarly, when the primary control valve 210*c* connects the fluid line 200*c* to the vacuum source, the secondary control valves 202–208 permit individual control of whether the chambers 160–166 are evacuated or vented to atmosphere.

The duration of application of the second pressure from the pressure regular 205 to the chamber 160 (and thus zone 301) can be controlled by actuating the valve 202 independently from other valves 204–208. Similarly, the duration of application of the second pressure to each of the other pressurizable chambers 162–166 (and thus to each of the other zones 303–307) can be independently controlled by the position of the associated secondary valve 204–208. That is, the secondary control valves 202–208 permit the application of pressure to each of the concentric zones 301–307 to vary independently in duration. Thus, rather than applying a different pressure to each chamber, the secondary control valves 202–208 control the duration of application of the second pressure to each chamber. This permits a single pressure regulator 205 to control the common pressure in the concentric zones 301–307, while maintaining control of the amount of material removed from each zone by adjusting the duration of the pressure with the secondary control valves 202–208.

Three pressure sensors or gauges 215*a*, 215*b* and 215*c* can be provided to indicate the pressures in each of the associated fluid lines 200*a*, 200*b* and 200*c*, respectively.

A general-purpose digital computer 220 can be connected to pressure regulators 201–205, control valves 210*a*–210*c* and 202–208, and pressure gauges 215*a*–215*c* to control pressurization or evacuation of the chambers 108, 168, and 160–166.

In operation, to press the retaining ring 110 against the polishing pad, the control valve 210*a* is actuated to connect the pressure regulator 201 to the fluid line 200*a* and the chamber 108. On the other hand, to lift the retaining ring away from the polishing pad, the control valve 210*a* is actuated to connect the vacuum source to the fluid line 200*a* and the chamber 108.

Similarly, to press the edge portion of the flexible membrane 118 against the substrate, the control valve 210*b* is actuated to connect the pressure regulator 203 to the fluid line 200*b* and the chamber 168. On the other hand, to seal the chamber 168, e.g., during a wafer sensing step, the control valve 210*b* is actuated to connect the fluid line 200*b* and the chamber 168 to a block.

The secondary control valves 202–208 can be used to control the amount of material removed from each of the concentric zones 301–307 of the substrate during polishing. As discussed above, each of the secondary control valves 202–208 can control the duration of application of the second pressure from the pressure regulator 205 to the associated chamber 162–168. Controlling the duration of application of the pressure to each chamber permits to control the duration of application of a load from each chamber to the associated concentric zone, independently from other concentric zones. For example, if pressure regulator 205 generates a positive second pressure, and actuation of the control valve 202 permits the fluid flow from the branch line 222 into the chamber 160, the second load will be applied to the associated zone 301. Pressurization of the chamber 160 will continue as long as the valve 202 is activated. When the valve 202 is vented, the fluid flow to the chamber 160 will discontinue even though the branch line 222 will remain under the second pressure. Consequently, no load will be applied to the zone 301. Thus, the secondary valves 202–208 can vary the duration of application of the second pressure to different portions of the flexible membrane 140 defined by the pressurizable chambers 160–166. Specifically, each of the concentric zones 301–307 can be independently polished under the second pressure for a different period of time. For example, rather than apply a pressure of 8.0 psi to the chamber 160, a pressure of 6.0 psi to the chamber 162, and a pressure of 4.0 psi to chambers 164 and 166, a pressure of 8.0 psi may be applied to all four chambers 160–166 chambers, while the duration of application of the pressure will be 1 minute for the chamber 160, 45 seconds for the chamber 162, and 30 seconds for chambers 164 and 166. By varying the polishing parameter of the duration of pressure applied to different zones from the plurality of the concentric zones 303–309, the amounts of material removed from each zone can be varied.

Thus, in this implementation, even when using a single pressure regulator, independent control of the amount of material removed from the multiple zones on the backside of the substrate can be achieved. The duration of application of the second pressure to each of the concentric zones 301–307 can be selected to compensate for the polishing rate in each particular zone. The durations can be determined experimentally and included as a part of the program of the computer 220.

If the control valve 210*c* is connects the fluid line 200*c* to vacuum, at least some of the chambers 160–166 can be evacuated. Evacuation of the chambers 160–166 can vacuum-chuck the substrate to the carrier head.

As previously discussed, one problem encountered in multi-zone polishing is that the control system typically requires multiple independent pressure regulators and a large number of pressure regulators and valves. The large number of components increases cost and reduces reliability of the polishing system. However, the control system of the present invention can reduce the number of pressure sensors and pressure regulators by replacing them with simple software timing controls. This decreases the cost of the components and improves the reliability of the system. Specifically, only three pressure regulators are needed to independently control the load on the retaining ring 110, the edge portion 309 of the substrate, and the concentric zones 301–307. This is possible because the system uses a common pressure regulator for the concentric zones 301–307.

It should be understood that the number of the pressurizable chambers formed between the base assembly 104 and the internal membrane 140 can increased to provide more concentric zones on the backside of the substrate. For each additional chamber, there would be an associated secondary control valve. However, the control system would not need an additional pressure regulator.

Another problem, discussed above, with conventional pressure control systems is that the multiple independent pressure regulators are not necessarily accurate. For example, if it is desired to apply a 4.00 psi pressure uniformly across the substrate, the different regulators may actually apply different pressures, e.g., 4.05, 3.95, 4.00, 4.05, and 4.00 psi, in their respective zones, resulting in spatially non-uniform polishing across the substrate. This effect is exaggerated when polishing is performed at lower pressure and the regulator fluctuation becomes a large percentage of the overall polish pressure.

A potential advantage of the present invention is that it allows for more accurate control of the polishing process and improved polishing uniformity. Specifically, because the same pressure regulator regulates the plurality of chambers 160–166, the same pressure is applied to the concentric zones 301–307. Thus, potential non-uniformity due to differences in the pressure regulators is reduced. On the other hand, the system can still compensate for non-uniform polishing rates or non-uniform thickness of the incoming substrate by varying the duration for which pressure is applied to each chamber 160–166.

The control scheme also permits independent pressure control of the edge portion 309. Specifically, when fluid is directed into chamber 168 to apply a downward load to the substrate for the polishing step, the load on the central portion 309 can be varied independent from the load on other areas on the backside of the substrate.

Referring to FIG. 4, in another implementation, the control scheme for application of the third and first loads to the retaining ring 110' and the central portion 301', respectively, are identical to the system shown in FIG. 3. That is, two pressure regulators 201 and 203 can be connected to two fluid lines 200*a′* and 200*b′*, respectively, to control the load applied to the retaining ring 110' and the edge portion 309', respectively.

Two pressure regulators 207 and 209 can be connected to two fluid lines 200*c′* and 200*c″*, respectively, control the load applied to the concentric zones 301–307. Specifically, a first pressure regulator 207 can be connected to the first fluid line 200*c′* via a first primary control valve 210*c′*, and a second pressure regulator 209 can be connected to the second fluid line 200*c″* via a second primary control valve 210*c″*. One primary control valve 210*c′* can connect the first fluid line 200*c′* to either the first pressure regulator 207 or to a vacuum source, whereas the other primary control valve 210*c″* can connect the second fluid line 200*c′* to either the second pressure regulator 209 or to a vent.

Each of the fluid lines 200*c′* and 200*c″* can include a plurality of fluid branch lines 222', 224', 226', 228' and 222", 224", 226", 228", respectively. A set of secondary three-way control valves 202', 204', 206', and 208' can fluidly connect the respective pressurizable chambers 160–166 to either the fluid line 200*c′* via respective branch lines 222'–228', or to the fluid line 200*c″* via branch lines 222"–228". Two pressure sensors, or gauges, 215*c′* and 215*c″* can be provided to indicate the pressure in each of the fluid lines, 200*c′* and 200*c"*, respectively.

When the control valve 210*c′* is open, and pressure regulator 207 directs a fluid, e.g., a gas, under the second pressure through the branch lines 222'–228' into the chambers 160–166, each of the secondary control valves 202'–208' can be selectively activated to apply the second load to each of the concentric zones 301'–307' respectively. On the other hand, when control valve 210*c″* is open, and the pressure regulator 209 directs a fluid under a fourth pressure through the branch lines 222"–228" into chambers 160–166, each of the valves 202'–208' can be selectively activated to apply the fourth load to each of the concentric zones 301'–307'. Because the secondary control valves 202'–208' are three-way valves, each valve can be activated to apply either pressure from the pressure regulator 207 or from the pressure regulator 209 to the associated pressurizable chamber at any given time.

In short, depending on the secondary valve configurations, each chamber can be independently switched to receive either one of a first pressure (from the first pressure regulator 207) or a vacuum (depending on primary control valve 210*c′*), or one of a second pressure (from the second pressure regulator 209) or vent (depending on primary control valve 210*c′*). This permits some zones to use a higher, more aggressive pressure while the other zones use a less aggressive, or normal pressure. As discussed above, the secondary control valves 202'–208' can be used to control the duration during which a load is be applied to a particular concentric zone, alternatively they can be used to alternate between high and low pressures.

A number of embodiments of the invention have been described. Nevertheless, it will be understood that various modifications may be made without departing from the spirit and scope of the invention. Accordingly, other embodiments are within the scope of the following claims.

What is claimed is:

1. A polishing system, comprising:

a carrier head having a plurality of pressurizable chambers;

a common pressure regulation line having a first pressure;

a plurality of second lines having a second pressure that is different than the first pressure;

a plurality of first valves, each first valve associated with one of the pressure chambers and actuatable between a first position in which the first valve fluidly couples its associated pressure chamber with the common pressure regulation line and a second position in which the first valve fluidly couples its associated pressure chamber with one of the plurality of second lines.

2. The polishing system of claim 1, further comprising a pressure regulator and a second valve, the second valve actuatable between a first position in which the second valve fluidly couples the common pressure regulation line to the pressure regulator and a second position in which the common pressure regulation line is not fluidly coupled to the pressure regulator.

3. The polishing system of claim 2, further comprising a vacuum source, and wherein in the second position the second valve fluidly couples the common pressure regulation line to the vacuum source.

4. The polishing system of claim 1, wherein the plurality of second lines each vent to atmospheric pressure.

5. The polishing system of claim 1, wherein the plurality of second lines are coupled to a second common pressure regulation line.

6. The polishing system of claim 5, further comprising a first pressure regulator, a second pressure regulator, a second valve, and a third valve, the second valve actuatable between a first position in which the second valve fluidly couples the common pressure regulation line to the first pressure regulator and a second position in which the common pressure regulation line is not fluidly coupled to the first pressure regulator, and the third valve actuatable between a first position in which the third valve fluidly couples the second common pressure regulation line to the second pressure regulator and a second position in which the second common pressure regulation line is not fluidly coupled to the second pressure regulator.

7. The polishing system of claim 6, further comprising a vacuum source, and wherein in the second position the second valve fluidly couples the common pressure regulation line to the vacuum source.

8. The polishing system of claim 6, wherein in the second position the third valve fluidly couples the second common pressure regulation line to a vent.

9. A method for the chemical mechanical polishing of a substrate, comprising:

pressing the substrate against a polishing pad with a carrier head having a plurality of chambers;

causing relative movement between the polishing pad and the substrate;

applying a common first pressure to a plurality of chambers in the carrier head using a common regulator, wherein a duration of application of the first pressure to each chamber from the plurality of chambers is controlled independently from other chambers.

10. The method of claim 9, further comprising applying a second pressure to a second chamber that controls a pressure on the substrate, wherein the second pressure is controllable independently of the first pressure.

11. The method of claim 10, further comprising applying a third pressure to a third chamber, wherein the third pressure is controllable independently of the first and second pressures.

12. The method of claim 11, wherein the third pressure is applied to a retaining ring surrounding the perimeter of the substrate to press the retaining ring against the polishing pad to retain the substrate.

13. The method of claim 10, wherein the second pressure is applied against an edge portion of the backside of the substrate.

14. The method of claim 13, wherein the substrate is substantially circular and wherein the first pressure is applied by the plurality of chambers to a portion of the substrate surrounded by the edge portion.

15. The method of claim 14, wherein the portion of the substrate surrounded by the edge portion comprises a plurality of concentric zones, and wherein each chamber from the plurality of chambers applies the first pressure to one of the concentric zones from the plurality of concentric zones.

16. A method for controlling the polishing pressure over the regions of a substrate in a chemical mechanical apparatus, comprising:

controlling a first pressure exerted on an edge region of the substrate by a first pressure regulator;

controlling a second pressure exerted on a plurality of the substrate regions, other than the edge region, by a second pressure regulator, wherein the amount of material removed from each region of the plurality of regions is controlled independently from other regions.

17. A polishing system, comprising:

a carrier head including:

a flexible membrane providing a substrate-mounting surface, the volume between the base assembly and the flexible membrane forming a first chamber and a plurality of second chambers; and a retaining ring joined to the base assembly; and a pressure controller applying a first pressure to the retaining ring, a second pressure to the first chamber and a first portion of the substrate, and a third pressure to the plurality of second chambers, wherein each of the plurality of second chambers applies the third pressure to an associated segment of the substrate.

18. The polishing system of claim 17, further comprising a controller to independently control a duration of application of the third pressure to each chamber from the plurality of second chambers.

* * * * *